US006742235B2

(12) United States Patent
Blacket et al.

(10) Patent No.: US 6,742,235 B2
(45) Date of Patent: Jun. 1, 2004

(54) FASTENING OF SHEET MATERIAL

(75) Inventors: Stuart Edmund Blacket, Closeburn (AU); Nicholas Richard Clew, Farmington Hills, MI (US)

(73) Assignee: Henrob Limited (GB)

( * ) Notice: Subject to any disclaimer, the term of this patent is extended or adjusted under 35 U.S.C. 154(b) by 0 days.

(21) Appl. No.: 09/925,244

(22) Filed: Aug. 8, 2001

(65) Prior Publication Data

US 2003/0154588 A1 Aug. 21, 2003

Related U.S. Application Data

(63) Continuation-in-part of application No. 09/856,092, filed on May 15, 2001.

(30) Foreign Application Priority Data

Nov. 17, 1998 (GB) ..... 9825119
Aug. 23, 1999 (GB) ..... 9919854
Nov. 17, 1999 (WO) ..... PCT/GB99/03823

(51) Int. Cl.[7] ..... B23P 11/00

(52) U.S. Cl. ..... 29/432.2; 29/798; 29/521; 29/243.53

(58) Field of Search ..... 29/798, 432, 432.1, 29/432.2, 505, 818, 243.53, 283.5, 521

(56) References Cited

U.S. PATENT DOCUMENTS 3,615,274 A * 10/1971 Belada ..... 29/432
4,726,504 A * 2/1988 Halbert ..... 227/8
5,051,020 A * 9/1991 Schleicher ..... 29/798
5,752,305 A * 5/1998 Cotterill et al. ..... 29/432.2
6,276,050 B1 * 8/2001 Mauer et al. ..... 29/243.53
6,385,843 B1 * 5/2002 Singh et al. ..... 29/798

FOREIGN PATENT DOCUMENTS

WO WO 94/14554 7/1994

* cited by examiner

*Primary Examiner*—David P. Bryant
(74) *Attorney, Agent, or Firm*—Piper Rudnick LLP

(57) ABSTRACT

A fastener such as a self piercing rivet is inserted into sheet material without full penetration such that the deformed end of the rivet remains encapsulated by an upset annulus of the sheet material. The sheet material is disposed between a nose and a die of fastening apparatus. The rivet is inserted into the sheet material by means of a plunger that is reciprocal relative to the nose. Prior to rivet insertion no significant clamping force is applied to the sheet material and material immediately around the rivet insertion location is allowed to flow towards the rivet as to rivet is inserted. Thereafter during a second stage (being after said first stage) of rivet insertion a clamping force of sufficient magnitude is applied between the nose and the die in the region around the rivet insertion location so as substantially to prevent flow of displaced sheet material away from the rivet. The invention may also be applied to panel clinching. The resulting joints are of improved mechanical strength and fatigue life. Certain components of the apparatus of the present invention have an improved life expectancy.

22 Claims, 7 Drawing Sheets

STATIONARY
ADVANCE
RETRACT
POSITION 1
POSITION 2
POSITION 3
POSITION 4
POSITION 5
POSITION 6
POSITION 7
POSITION 8
S
D
R 72
85
73
86

ADVANCE
72
74
73
D
POSITION 5

ADVANCE
73
74
POSITION 4

ADVANCE
73
R
S
74
POSITION 3

ADVANCE
73
POSITION 2

STATIONARY
80
72
85
79
74
R
75
73
POSITION 1

FASTENING OF SHEET MATERIAL

CROSS REFERENCE TO RELATED APPLICATION

This application is a continuation-in-part of U.S. application Ser. No. 09/856,092, filed Aug. 22, 2001.

The present invention relates to a method and apparatus for fastening sheet material by self-piercing riveting or clinching. The term "clinching" is also known as "press joining" or "integral fastening".

Methods and apparatus for riveting of the kind in which a self-piercing rivet is inserted into sheet material without full penetration, such that the deformed end of the rivet remains encapsulated by an upset annulus of the sheet material are known.

FIG. 1 is a diagrammatic section of an example of a riveted joint made by such a riveting method in accordance with the invention. A rivet 1 has a head 2 and a shank 3 terminating in an annular edge 4. The shank 3 is initially cylindrical but is flared outwardly into the illustrated shape as the rivet is driven into two overlapping sheets 5,6 located on a suitably shaped die. As shown, the shank and the edge of the rivet 1 remain embedded in the sheet material 5,6 after the rivet has been set.

An improved self-piercing riveting method is described in our European Patent No. 0675774. In this method the sheet material is clamped in the region around the rivet insertion with substantial force prior to the commencement of insertion of the rivet and then during rivet insertion. Clamping is applied between a nose of the riveting machine and the die in the region around the rivet insertion location so that there is minimal distortion of the sheet material during the riveting operation. The process is achieved by using two concentric and independently operable hydraulic cylinders. An outer cylinder applies the clamping force and the inner cylinder applies force to insert the rivet. This method has been proved to increase the strength of the riveted joint and reduce the depth of the annular valley 7. However, the relatively high level of clamping force required to achieve the improved joint characteristics means that a significant pressure of hydraulic fluid or a heavy-duty spring is required to apply the force. Furthermore, if reaction forces within the joint resulting from rivet insertion exceed the clamping force, the nose will be pushed back up away from the die. This results in a reduction of the potential residual compressive stress that could be imparted to the region around the rivet.

Although the hydraulic riveting process described in our aforementioned patent is effective in producing distortion free joints that have improved fatigue life and reduced standard deviation in static strength, it is does require a relatively bulky rivet setter. Moreover, the two-stage process of applying the clamping force and then applying the rivet insertion force adds to the cycle time.

In other riveting apparatus the two-stage process is replaced by a single stage operation in which the clamping force is provided by the compression of a single internal spring between the nose and the actuator of the rivet setter (hereinafter referred to as "spring clamping"). In a single smooth stroke the clamping force is applied to the sheet material before insertion of the rivet and is increased as the actuator descends and compresses the spring. After predetermined travel distance the punch fitted to the end of the actuator comes into contact with the rivet and insert it into the she material. Continued compression of the spring occurs during insertion of the rivet so that the clamping force continues to increase.

Spring clamping of this kind has disadvantages in several respects. First, tests have established that the fatigue life of a riveted joint produced according to the method is significantly reduced in comparison that of a joint produced using the two-stage process. Secondly, the life of the spring is relatively short unless it is of a considerable size (and therefore very bulky in comparison to a hydraulic clamp). The life of a spring is dependent on its initial load, its final (fully compressed) load and the length of travel between these two positions. Since effective clamping of sheet material for self-piercing riveting requires forces of around 4 to 8 kN and rivets can be in excess of 15 mm in length the spring must be designed to withstand the repeated application of such loads over such stroke lengths. The life of such a spring is typically 100,000 cycles or less. Such rapid degradation of the spring results in the production of joints of variable and unpredictable quality. The riveting apparatus and process thus require stringent monitoring systems and frequent preventative maintenance. An alternative option is to use a larger spring with a better specification but this is usually too bulky to accommodate in a rivet setting apparatus of reasonable size. Thus the life of the spring is usually compromised.

In tests conducted by the applicant, a pair of aluminum sheets (5000 series) of 2 mm thickness were riveted together using a two-stage hydraulic process hydraulic clamping force applied prior to rivet insertion and another pair of identical sheets were riveted using spring clamping. The respective clamping forces were of identical magnitude. The joint produced with hydraulic clamping was found to have a fatigue life of around 1.2 million cycles when tested at 40% of the tensile load to failure (970 lb in this case). The fatigue test applied a tensile load cycling between 388 lb (40% of the tensile failure load) and 38.8 lb (i.e. 10% of the maximum) at a frequency of 20 Hz. In contrast, the joint produced with spring clamping had a fatigue life of only 0.6 million cycles. A further test established that a riveted joint produced without any significant clamping force (i.e. the force applied is sufficient only to hold the nose of the rivet setter steady against the sheet material during the riveting operation but has no effect on the flow or displacement of material of the sheet during rivet insertion) had a fatigue life of 1.1 million cycles.

Self-piercing riveting is closely related to clinching in which two sheets of metal are deformed into locking engagement using a punch-and-die combination. An improved clinching method is described in our European Patent No. 0614405. In this method a hollow rivet or tubular slug is inserted into a clinched joint between sheets and the inner end of a shank of the rivet is outwardly deformed within the clinched joint in such a way that it does not penetrate the panels.

In both clinching and self-piercing riveting methods a C-frame is used to support the riveting apparatus and die. A lower limb of the C-frame supports the die and, in use, deflects a certain distance during the riveting operation as a result of the rivet insertion and clamping forces. This means that in hydraulic clamping systems top-up hydraulic fluid is generally required to maintain the required level of clamping. The slow response of hydraulic fluid systems to the demand for extra loading leads to relatively long cycle times.

It is an object of the present invention to obviate or mitigate the aforesaid disadvantages and to provide for an improved method and apparatus for fastening sheet material by self-piercing riveting or clinching.

According to a first aspect of the present invention there is provided a method for inserting a fastener into sheet material comprising inserting the fastener into at least one sheet without full penetration such that a deformed end of the fastener remains encapsulated by an upset annulus of the sheet material, the sheet material being disposed between a nose and a die of fastening apparatus and the fastener being inserted into the sheet material by means of a plunger that is reciprocal relative to the nose, characterised in that, during a first stage of fastener insertion the sheet material around the fastener insertion location is displaced towards the fastener by virtue of its insertion, and thereafter during a second stage (being after said first stage) of fastener insertion a clamping force of sufficient magnitude is applied between the nose and the die in the region around fastener insertion location so as substantially to prevent flow of displaced sheet material away from the fastener.

The clamping of the sheet at the last stage of insertion of the fastener in this way ensures that favourable compressive stresses are built into the region around the fastener insertion location and, in the case where one or more sheets are being joined, also ensures that fatigue performance of the joints significantly improves in comparison to joints produced by conventional fastening methods. The application of the clamping force is timed to occur just as a head of the rivet being inserted is pressed flush and the material that was previously flowing into the die changes direction and begins to be pushed out of the die. Restraining this reverse flow is the key to creating favourable compressive stresses in the material around the rivet head and shank. The clamping force is sufficient to flatten any distortion that occurred during the initial stages of no or low clamping. It also brings the sheet materials into intimate contact with each other so as to provide a compact gap-free joint.

The absence of any significant clamping force during the initial stages of fastener insertion allows significant distortion to occur in the sheet material in the region surrounding the insertion location. The level of distortion is dependent on the number of sheets being joined and their thicknesses. Tests conducted by the applicant established that this distortion can be flattened by applying a significant clamping force to the material surrounding the inserted fastener just as it is pressed flush with the sheet material. Moreover, it was established that the fatigue life of the joint was surprisingly enhanced.

The clamping force is preferably provided by compression of a compressible member that is disposed between the plunger and the nose. The compressible member may be a plurality of disc springs or other resilient element.

Preferably the first stage of the fastener insertion comprises entry of the fastener into the sheet material and the second stage comprises the fastener being pressed substantially flush with an upper surface of the sheet material. The clamping force applied during the second stage of fastener insertion ideally increases until the fastener is fully inserted. During the first stage of fastener insertion preferably no clamping force is applied to the sheet material in the region around the fastener insertion location.

During the first stage of fastener insertion the nose of the apparatus may be biased into abutment with the sheet material so as to provide stable contact between the two.

The second stage of fastener insertion is preferably when a head part of the fastener is pressed flush with an upper surface of the sheet material.

According to a second aspect of the present invention there is provided apparatus for inserting a fastener into sheet material without full penetration such that a deformed end of the fastener remains encapsulated by an upset annulus of the sheet material, said apparatus comprising a nose in which is disposed a reciprocal plunger, means for feeding fasteners successively to the nose for insertion by the plunger into the sheet material, a die aligned with the plunger for deforming the fastener being inserted, the sheet material being disposed between the nose and die during the fastening operation, characterised in that there is provided means for applying a clamping force at a predetermined point during insertion of the fastener, said means for applying the clamping force allowing the sheet material around the fastener insertion location to be displaced by the fastener towards the fastener during a first stage of fastener insertion, and thereafter during a second stage (being after said first stage) of fastener insertion applies a clamping force of sufficient magnitude between the nose and the die in the region around fastener insertion location so as substantially to prevent flow of displaced sheet material away from the fastener.

According to a third aspect of the present invention there is provided a panel clinching method wherein two or more sheets of material are deformed into locking engagement, the sheet material being disposed between a nose and a die of fastening apparatus, the sheet material being deformed by means of a plunger that is reciprocal relative to the nose, characterised in that, during a first stage of deformation, the sheet material around the deformation region is displaced towards the plunger by virtue of its insertion into the material, and thereafter during a second stage (being after said first stage) of deformation a clamping force of sufficient magnitude is applied between the nose and the die in the region around the deformation so as substantially to prevent flow of displaced sheet material away from the plunger.

Specific embodiments of the present invention will now be described, by way of example only, with reference to the accompanying drawings in which.

Figures 8A, 8B, 8C, 8D, 8E, 8F, 8G, 8H:
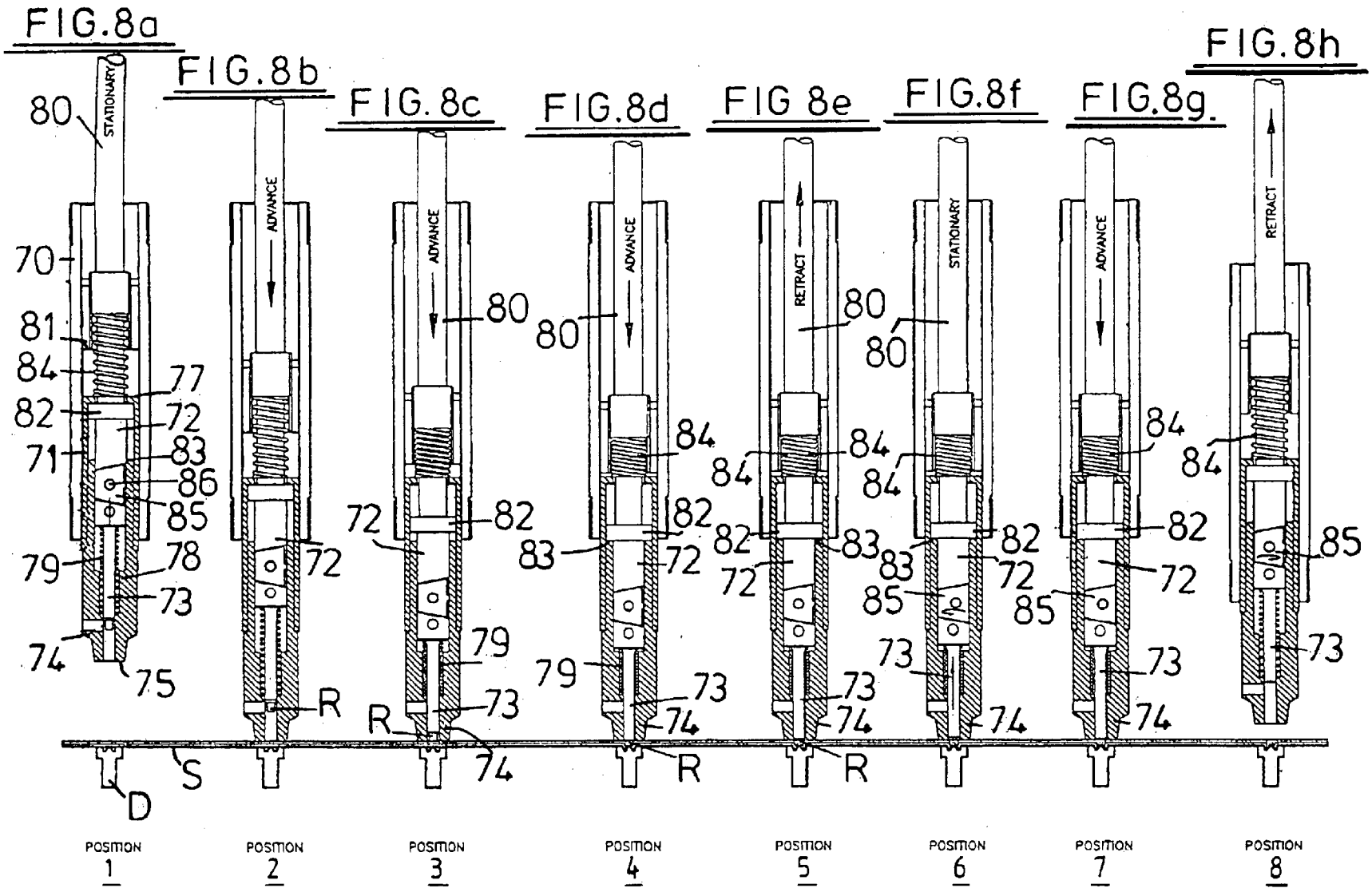
Figures 8I, 9A, 9B, 9C, 9D, 9E:
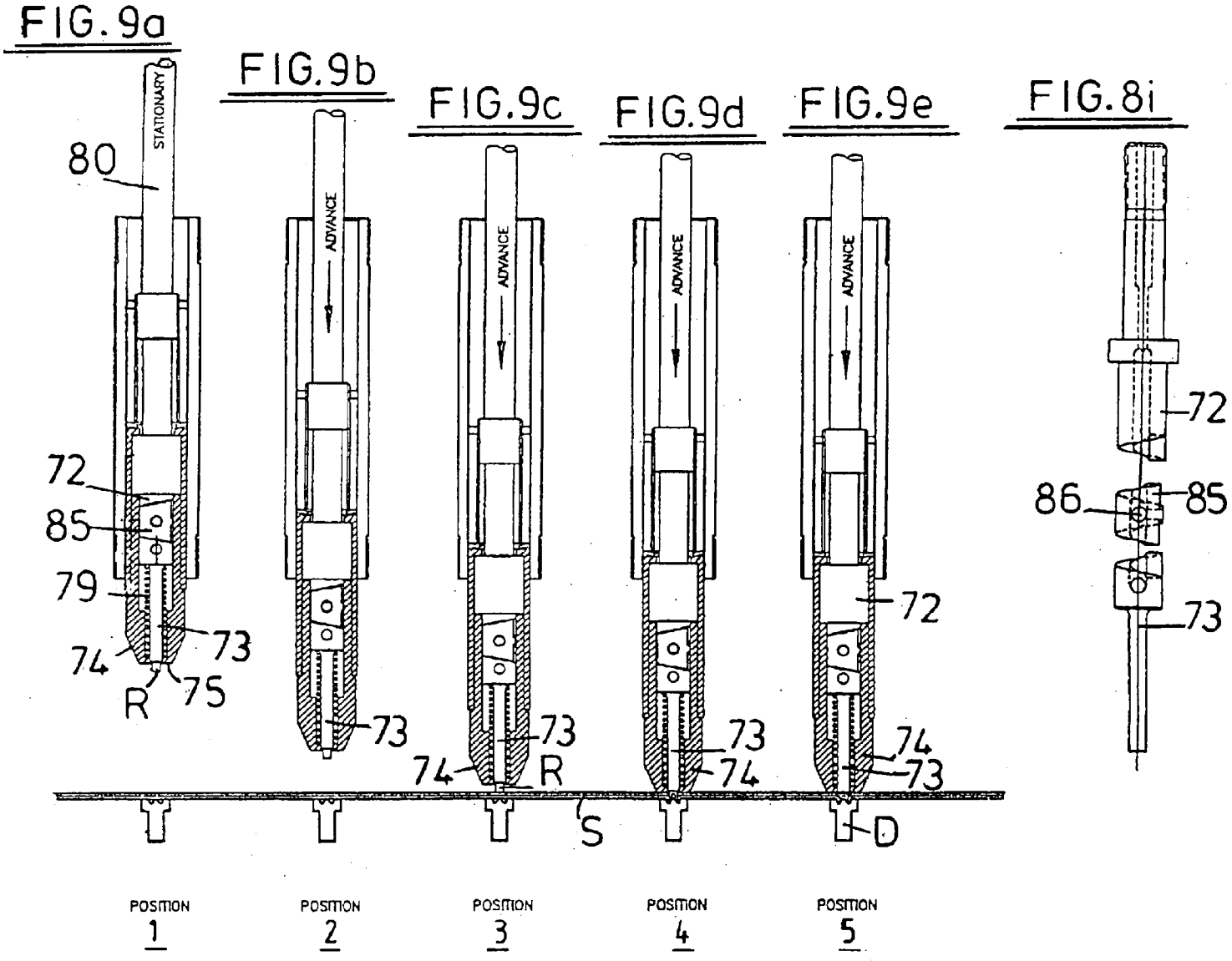

FIGS. 8*a* to 8*h* are longitudinal sectioned views of a rivet setter and die of the present invention showing in a sequence of chronological steps a method of fastener insertion;

FIG. 8*i* is an exploded view of a plunger and punch assembly of the rivet setter of FIGS. 8*a* to 8*h* and 9*a* to 9*e;*

FIGS. 9*a* to 9*e* are longitudinal sectioned views of a rivet setter and die showing a chronological sequence of an alternative method of fastener insertion in accordance with an aspect of the present invention; and FIGS. 10*a* to 10*e* are longitudinal sectioned views of a rivet setter and die showing a chronological sequence of a further alternative method of fastener insertion in accordance with an aspect of the present invention.

Figure 1:
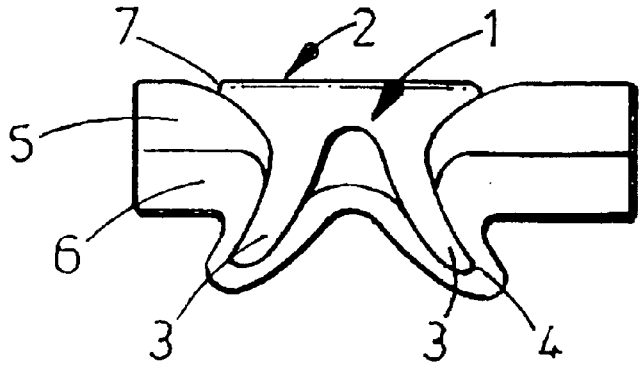
FIG. 1 is a section of a riveted joint made by the fastening method of the present invention.

Referring now to the drawings, the riveted joint of FIG. 1 has already been described as an example of the kind of joint that is produced by the fastening method of the invention.

Figure 3:
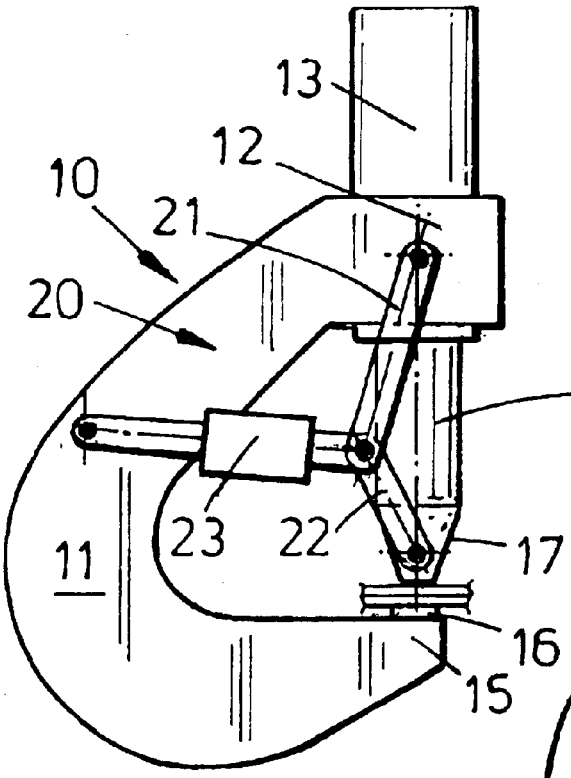
FIGS. 2 and 3 are diagrammatic illustrations of a first embodiment of a riveting machine shown mounted on a C-frame.
Figure 2:
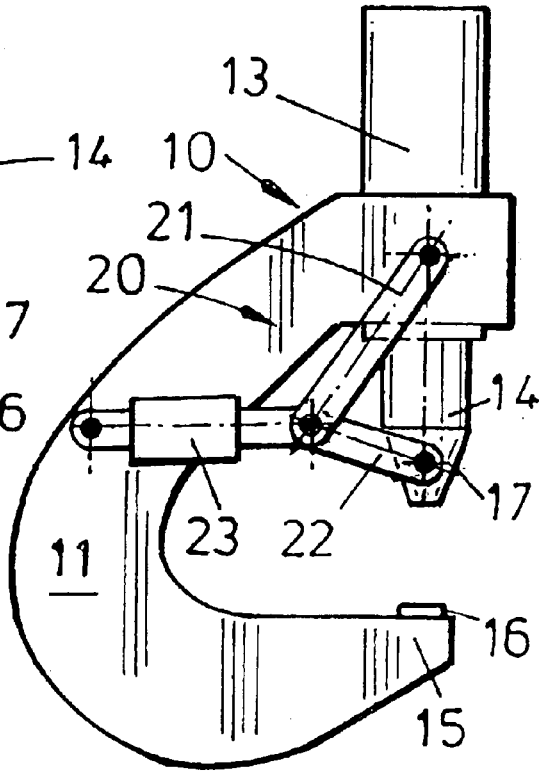

FIGS. 2 and 3 show a riveting machine 10 mounted on a conventional C-frame 11. An upper limb 12 of the C-frame 11 supports a fixed main cylinder 13 in which is received a retractable clamping cylinder 14 of the machine. The main cylinder 13 provides hydraulic pressure for actuation of the clamping cylinder and a rivet punch (not shown) that is coaxially slidable therein. A lower limb 15 of the C-frame 11 supports a die 16 directly below the clamping cylinder 14. The clamping cylinder 14 terminates in a nose 17 the end surface of which defines an annular clamping surface 18 that urges two overlapping sheets 19 against the die 16.

The movement of both the clamping cylinder 14 and the punch is driven by a hydraulic fluid pressure as is well known and discussed in our aforementioned European Patent. However, other punch drive mechanisms may be used such as an electrically powered screw assembly. Furthermore, the clamping cylinder may alternatively be driven by an electrically powered actuator or via a spring from the punch.

A mechanical linkage 20 is connected to the C-frame 11 and to the nose 17 in order to maintain the extension of the nose 17 towards the die 16 during the riveting operation. The linkage 20 comprises a first link member 21 fixed at one end to the upper limb 12 of the C-frame 11 and a second link member 22 connected to the nose 17, the two link members 21, 22 being pivotally interconnected at their other ends. The linkage 20 is controlled by an actuator 23 connected between the C-frame 11 at a location intermediate the upper and lower limbs 12, 15 and the pivot between the first and second link members 21, 22. In use, the linkage 20 moves in synchronism with the descent of the clamping cylinder 14, or, alternatively, is acted upon by the actuator 23 to advance the clamping cylinder 14, between an extended position, shown in FIG. 3, in which the nose 17 is in clamping contact with the sheets 19 and a contracted position, shown in FIG. 2, in which the nose 17 is retracted towards the upper limb 12 of the C-frame 11. The actuator 23 serves to drive and hold the mechanical linkage 20 in the extended position so that retraction of the nose 17 relative to the C-frame 11 is prevented until such time as the riveting process is complete and the clamping pressure is released whereupon the actuator 23 is released.

The riveting operation is performed as follows. A rivet of the kind shown in FIG. 1 is delivered to the end of the nose 17 in a conventional manner ready for insertion into the sheets 19. The clamping cylinder 14 descends downwards from the retracted position shown in FIG. 2 to the position shown in FIG. 3 and applies a light to moderate clamping force between the nose 17 and the die 16. The mechanical linkage 20 either extends simultaneously with, or drives the descent of the clamping cylinder 14 and a restraining force is applied by the actuator 23 to the linkage so as to prevent reverse movement of the nose 17 during the riveting operation, thereby controlling the position of the nose 17 in relationship to the die 16. As soon as the pre-selected clamping force is reached a pressure switch or load cell etc. (not shown) signals the punch to advance for the riveting operation. The clamping force may be maintained throughout the rivet insertion or may be reduced or increase by means of varying the pressure in the actuator. The punch then descends within the clamping cylinder 14 to insert the rivet into the sheets 19.

The timing and co-ordination of above operation is conducted under the control of a programmable logic controller or a similar automatic control device. It will be understood that the riveting operation may be supplemented by the inclusion of a coining ring and/or an adhesive applied to the nose as described in our aforementioned European Patent.

Figure 4:
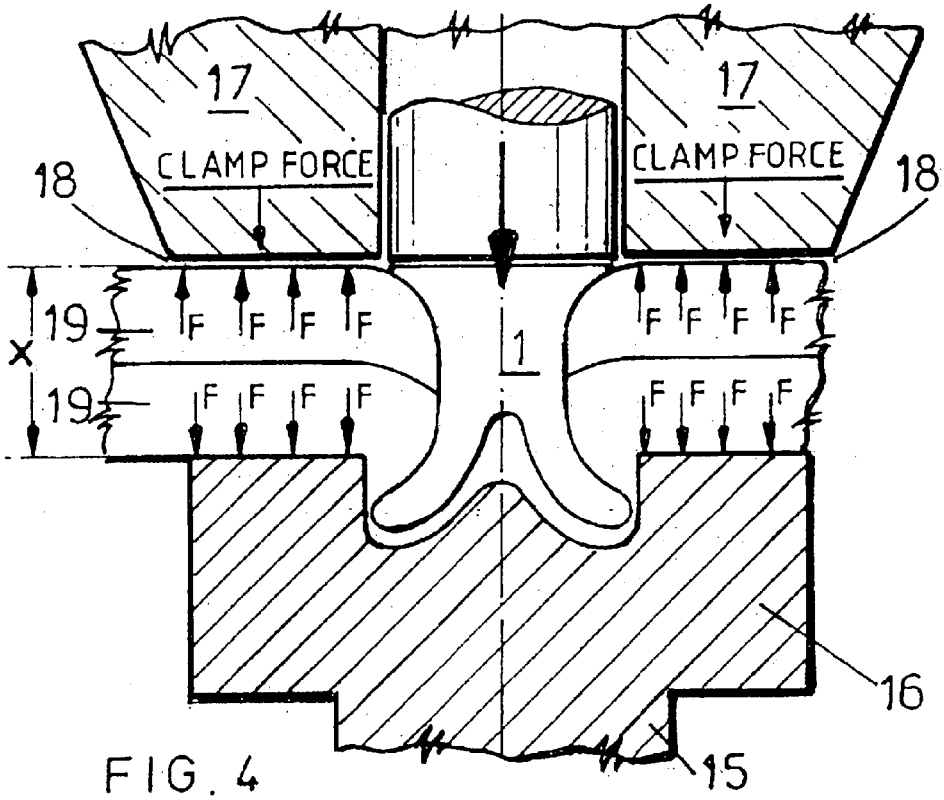
FIG. 4 is a diagram showing the internal stresses of a joint being riveted in accordance with the method of the present invention.

The insertion of the rivet is illustrated in FIG. 4. Whilst the clamping force is applied by the nose 17 to the sheets 19 there is a corresponding equal and opposite reaction force applied by the die 16 to the sheets 19. In addition to this there are further reaction forces generated by the tendency of the sheets to deform as the rivet penetrates the sheets under action of the punch. Initially sheet material is drawn into the die cavity by the rivet as it is inserted. As the rivet is fully inserted and fills the die cavity, sheet material is displaced out of the cavity. This displaced material generates reaction forces against the nose and the die. The reaction forces, illustrated by the arrows F in FIG. 4, exceed the clamping force and act against the nose 17 which would normally be deflected outwardly away from the die 16 by the reaction forces generated by the deformation of the sheets 19. However, since the nose 17 is restrained from moving away from the die 16 by operation of the linkage 20 when in the clamping position, it is not deflected and the joint is correspondingly compressed. The compressive stress applied during the riveting process provides the joint with improved fatigue life.

The advance of the punch during insertion of the rivet into the joint applies increased force to the sheets and the die 16 and lower limb 15 of the C-frame 11 tend to deflect slightly downwardly under the increased load. The deflection of the C-frame is followed by the nose 17 in order that the clamping force is maintained. The mechanical linkage 20 is able to extend slightly further to allow this additional travel of the nose 17. When the riveting force is removed, (i.e. the insertion of the rivet is complete and the punch is retracted into the nose) but whilst the clamping force is still maintained, the lower limb 15 of the C-frame 11 will attempt to spring back to an equilibrium position against the nose 17. In the absence of the linkage 20 the nose 17 would be deflected upwards until the force (applied by the clamping pressure) is equal to the reaction force of the lower limb of the C-frame. However, in the presence of the linkage 20 the nose 17 is not moveable relative to the C-frame and all of the reaction force from the riveting operation is thus transmitted via the die 16 back into the joint which becomes squeezed between the die 16 and nose 17 by a force which is substantial and approximately equal to the rivet insertion force (typically 2–5 tonnes less the initial clamping force). Since the punch is retracted fully into the nose the squeezing force is applied only by the nose. This results in both flattening of the joint and imparting of favourable compressive stresses providing advantageous strength and fatigue performance. After this post rivet-insertion 'squeeze' of the joint has been allowed to occur fully, the nose restraining device is disengaged so that it can retract ready for the next cycle.

The riveting method of the present invention allows for improved joint characteristics such as improved fatigue life without the need for a separately applied high clamping force. Research has established that initial clamping forces of zero or low to moderate such as 100 lbf or so are sufficient to ensure effective riveting using the method of the present invention although in practice higher or lower forces may be used. Moreover, additional top-up hydraulic fluid is not required to compensate for deflection of the C-frame.

Figure 7:
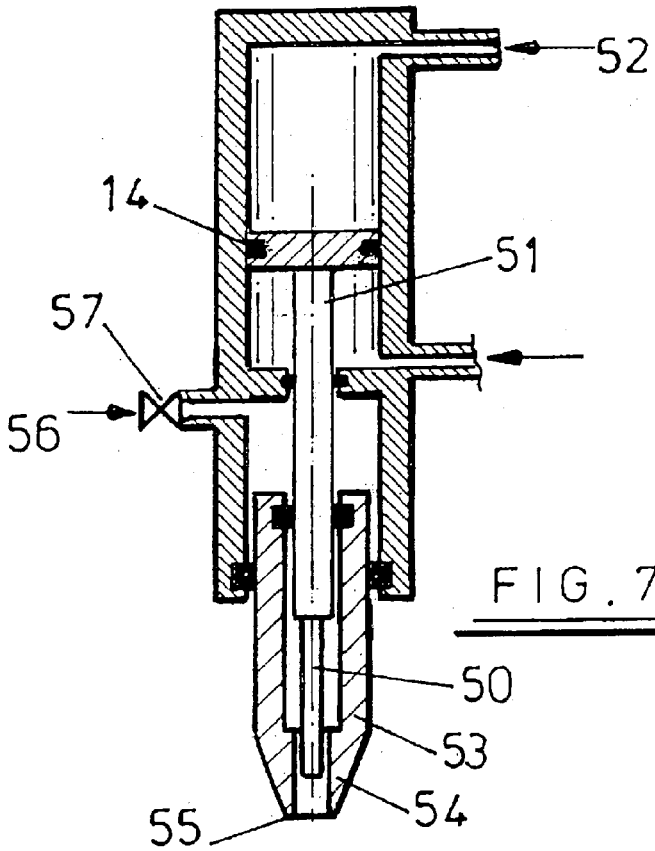
FIG. 7 is a diagrammatic representation of a fourth embodiment of a riveting machine.
Figure 5:
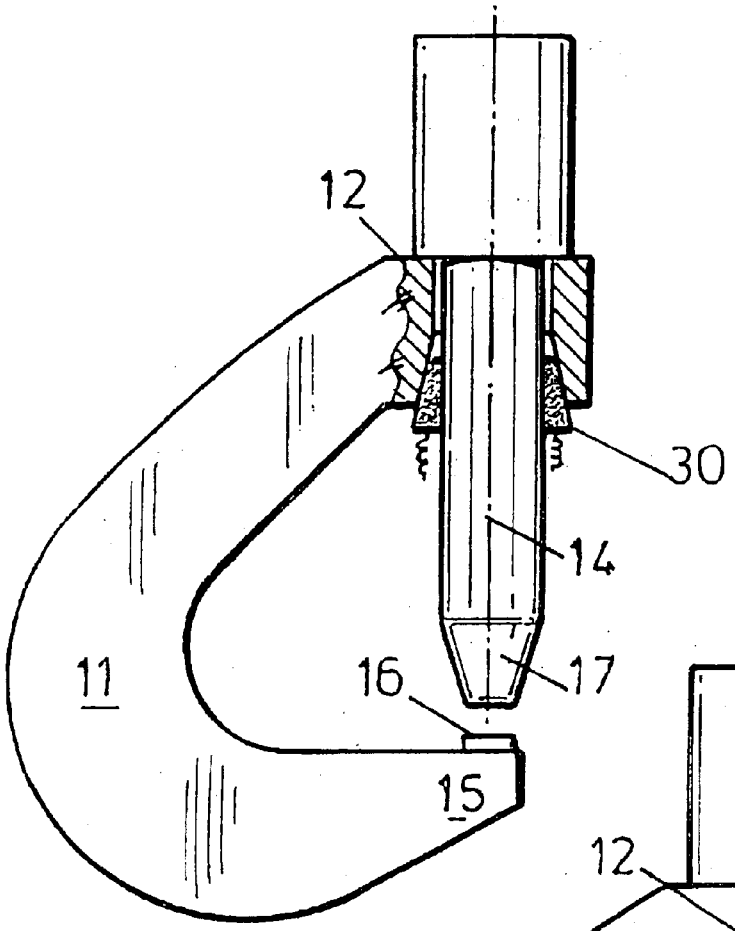
FIG. 5 is a diagrammatic side view of a second embodiment of a riveting machine.
Figure 6:
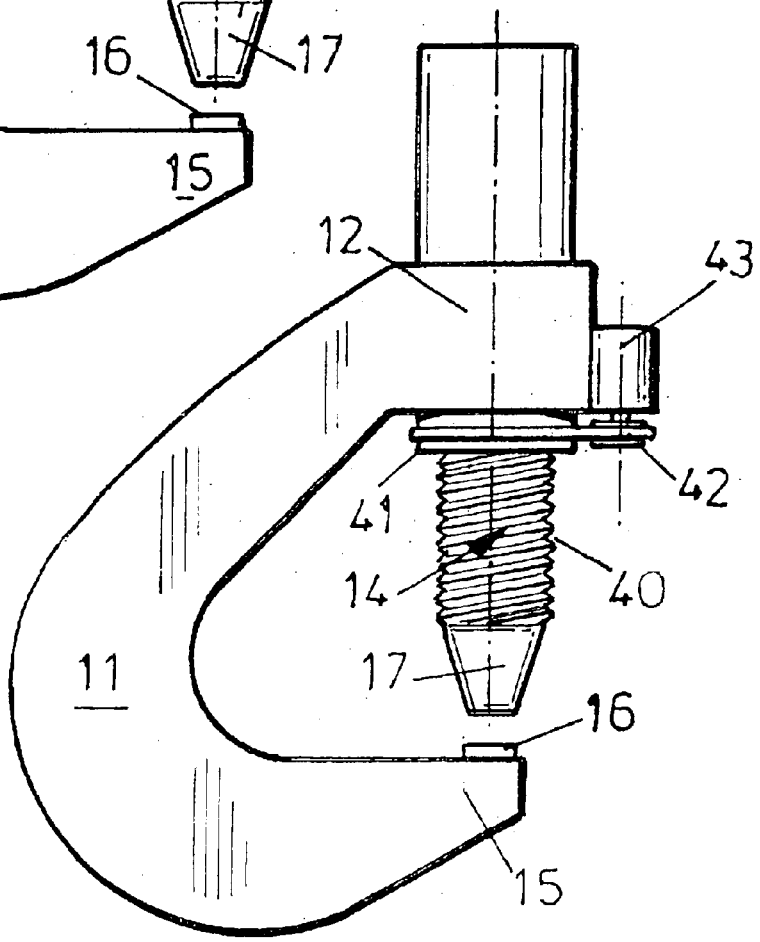
FIG. 6 is a diagrammatic side view of a third embodiment of a riveting machine.

Alternative designs of riveting machines are shown in FIGS. 5, 6 and 7. Components identical to those of the previous figure are given the same reference numerals. In the example shown in FIG. 5 the mechanical linkage is replaced by a spring-loaded wedge-shaped collar 30 that is mounted between the upper limb 12 of the C-frame 11 and the clamping cylinder 14. The collar 30 pets descent of the clamping cylinder 14 but prevents any reverse motion by a jamming effect until riveting process is complete. When the rivet has be inserted into the sheets 19 and the clamping force is released the wedge-shaped collar 30 is moved out of engagement with the C-frame 11 so as to permit ascent of the clamping cylinder 14 and therefore movement of the nose 17 away from the riveted joint.

In the embodiment of FIG. 6 the main cylinder has an exterior screw thread formation 40 that engages with a complementary internal thread of a rotary nut 41 disposed immediately below the upper limb 12 of the C-frame 11. The nut 41 is drivingly connected via a belt 42 to a motor 43 that is supported on the side of the upper limb 12. In operation, the travel of the clamping cylinder 14 relative to the C-frame 11 is effected by rotation of the nut 41 by the motor 43. The nut 41 is rotated until the nose 17 is in a clamping position on the sheets. The threads are designed to be of shallow pitch so that they tend to lock to prevent reverse movement of the main cylinder 14 during the riveting operation. Alternatively, the clamping cylinder may be hydraulically or otherwise driven and the screw thread acts as a complimentary lock to prevent reverse movement.

The riveting machine of FIG. 7 is substantially similar to that described in our aforementioned European Patent No. 0675774. A punch 50 is carried by a plunger 51 and is slidable within the main cylinder 14 under the influence of hydraulic pressure admitted through an inlet connector 52 of the main cylinder. The lower part of the cylinder 14 houses a slidable clamping cylinder 53 that terminates in a nose 54 the end face of which provides a clamping surface 55. The clamping pressure is provided by hydraulic fluid admitted through an inlet connector 56 in the main cylinder 14. In order to retract the clamping cylinder 14 and release the clamping pressure, a check valve 57 located in the inlet connector 56 is opened and fluid is allowed to escape back through inlet connector 56. The machine differs from conventional designs in that the hydraulic check valve 57 (or an equivalent device) is located in or close to the inlet connector 56 so as to limit the volume of hydraulic fluid that is held at the clamping pressure. This serves to restrain upward movement of the nose 54 and so enables the distance between the nose 54 and the die to be controlled.

It is to be understood that all the above designs can prevent the lower limb of the C-frame springing back to its equilibrium position after the riveting force is removed as described above in relation to the embodiments shown in FIGS. 2 and 3.

In a further alternative embodiment (not shown) a single actuator (for example a hydraulic cylinder or an electric motor) drives both the punch and nose. Once the nose contacts the sheets to be joined a relatively light spring force (e.g. 20 lbf) is applied whilst the punch continues to advance within the nose. The punch comes into contact with a rivet that has been delivered to the nose and drives it into the sheets. At the moment the rivet comes into contact with the upper sheet there is still only a relatively low clamping force being applied to prevent rattling of the rivet machine relative to the sheets. This very low force allows the sheet material being joined to flow so that it is dragged towards the die and into the die cavity by the advancing rivet resulting in the material immediately around the rivet being deformed into an annular valley. This occurrence allows more sheet material to flow into the die and results in relatively low tensile stresses being set up in the sheet material in the region around the rivet insertion location. As the head of the rivet is pressed flush with the upper surface of the top sheet a shoulder or stop on the punch abuts a complementary shoulder on the nose and prevents further travel of the punch relative to the nose. Thus any additional force applied by the actuator to the punch is shared between the punch and nose and serves to increase the clamping force between the nose and punch combination and the die. Both the rivet insertion force and the clamping force cause the lower limb of the C-frame to deflect as discussed above and this deflection is maintained as long as the punch remains the extended position.

At a predetermined time after the rivet insertion stroke of the punch is complete, the punch is retracted whilst the nose is retained in position using any appropriate restraining mechanism such as any one of those described above. The force applied by the actuator is now applied to the joint solely by the end surface area of the nose and C-frame reaction pushes the die and sheets towards the fixed nose so as to clamp or "squeeze" the sheets in the region around the rivet insertion location. Since the punch is retracted no load is imparted to the rivet at this point. This squeezing serves to flatten out the distortion of the sheets out of their planes that occurred during rivet insertion in the region around rivet insertion. In addition, it imparts compressive stresses into the sheet material around the rivet shank. Once the squeezing force has stabilised the nose is then retracted as before and the punch is reset for the next stroke.

The amount of clamping or squeezing force can be varied in several ways. The clamping force may be increased in magnitude by increasing the actuator load prior to lifting the punch once the rivet has been inserted. This does not drive the rivet further into the sheet material as advance of the punch relative to the nose is prevented by the abutting shoulders. The additional load is thus imparted to the C-frame which deflects further. Once the punch is retracted the C-frame reacts and the load is transferred into clamping of the joint. Similarly, the clamping force may be reduced by reducing the actuator load prior to retraction of the punch so that a lower force is reacted by the C-frame and imparted into the joint. The clamping force can be measured by means of a load cell associated with the actuator so that the load applied by the actuator can be controlled to achieve the required clamping force. This arrangement is advantageous as no additional stroke or loading of the actuator is required to impart the clamping force, thereby saving on cycle time and power.

The duration of the clamping force imparted into the joint is dependent on the stiffness of the C-frame and the control device (referred to above) is designed to take such factors into account during a preliminary calibration stage that establishes the required actuator load for a desired clamping force and a given C-frame stiffness.

By reducing the initial clamping force (i.e. that prior to rivet insertion) in favour of a post rivet-insertion force the impact on the nose of the riveting apparatus is reduced. In the embodiment described above the clamping force may be increased gradually in stages during and/or after rivet insertion thereby reducing the risk of impact damage to the nose. Furthermore, as the clamping force and the rivet insertion force are applied via the same actuator only a single supply of hydraulic fluid is require. This eliminates the need for a two-stage operation of clamping then riveting as in existing riveting apparatus. Such a single stage operation is ideally suited to electric actuators that hitherto have proven unsuitable for riveting operations in that the joints produced have been of poor quality.

The rivet setter and die shown in FIGS. 8*a* to 8*i* has a single actuator and can be used in the embodiment described immediately above or may be used in such a way that the clamping force is imparted to the sheet material joint after rivet insertion in a different manner as will now be described. The operation of the apparatus is shown as a series of chronological steps.

A cylindrical support tube 70 carries a clamping cylinder 71 that is coaxially slidable therein. The clamping cylinder 71 in turn supports internally coaxial plunger 72 that is slidable therein and carries a punch 73. The lower part of the clamping cylinder 71 terminates in an external nose 74 the end face 75 of which provides a clamping surface for the sheet material 5. The upper end of the clamping cylinder 71 defines an annular abutment shoulder 77 the purpose of which will be described below. The nose 74 is internally configured to define a guide bush 78 of relatively narrow diameter that receives the punch 73 in coaxial alignment and guides the punch 73 during relative sliding movement thereof against the bias of a coaxial punch spring 79. In the relaxed condition the punch spring 79 urges the punch 73 away from the outlet of the nose 74.

The plunger 72 is moveable in the clamping cylinder 71 by means of the shaft 80 of a linear actuator (not shown) the end of which supports an annular shoulder 81 for abutment with the shoulder 77 on the clamping cylinder 71. The respective shoulders 77, 81 serve to limit the extent of travel of the actuator shaft 80 in the support tube 70. Inside the clamping cylinder 71 the plunger 72 has a radially outwardly defined step that serves as a stop 82 that, in use, co-operates with an abutment shoulder 83 at the top of the guide bush 78 so as to limit the extent of travel of the plunger 72. A compression spring 84 is coaxially disposed between the actuator shaft 80 and the top of the clamping cylinder 71.

Interposed between the plunger 72 and the punch 73 is a rotary cam 85 that is actuable to allow the punch 73 to retract slightly into the nose 74 under the influence of the punch spring 79 as will be described below. The cam 85 is mounted on a pin 86 that rides in a slot (not shown) during reciprocal motion of the plunger 72 and punch 73. When it is desired to retract the punch 73 the cam 85 is rotated about the longitudinal axis of the rivet setter so as to reduce the distance between the proximate ends of the plunger 72 and punch 73. The slot is configured to allow such rotation to occur at a predetermined axial distance along the rivet setter.

At rest the actuator shaft 80, plunger 72 and punch 73 are retracted in the rivet setter as shown in FIG. 8*a*. In order to effect rivet insertion, the actuator shaft 80 is first advanced into the support tube 70 thereby forcing the clamping cylinder 71 to extend until the nose 74 is in contact with the sheet materials as shown in FIG. 8*b*. The nose 74 is now prevented from further movement and continued advance of the actuator shaft 80 compresses the compression spring 84 between the actuator shaft 80 and the plunger 72. The only clamping force applied to the sheet material around the rivet insertion location at this stage is that applied by the compression spring 84. The advance of the actuator shaft causes movement of the plunger 72 within the clamping cylinder 71 which in turn urges the punch 73 to move against the biasing force 79 of the punch spring into contact with a rivet R supplied through a side port in the nose 74 (see FIG. 8*c*). Further advance of the actuator shaft 80 forces the rivet R into the sheet materials as shown in FIG. 8*d*. During the final stages of full insertion of the rivet R the stop 82 on the plunger 72 comes into abutment with the shoulder 83 at the top of the guide bush 78 and any additional force applied by the actuator is evenly distributed across the nose and the punch as a late clamping force. The actuator shaft 80 is then retracted a short distance until the load applied by the punch to the rivet R is removed at which point there is still a small clamping force applied by the nose by virtue of the action of the compression spring 84 (FIG. 8*e*). When the punch 73 is unloaded the actuator stops and the cam 85 is rotated by an external actuator or a biasing spring (not shown) to allow the punch 73 to retract slightly (under the influence of the punch spring 79) into the nose 74 so that it no longer projects therefrom (FIG. 8*f*).

The actuator is then operated a second time so as to advance the shaft 80 again until the stop 82 on the plunger 72 abuts the shoulder 83 of the guide bush 78 (FIG. 8*g*). As a result of the orientation of the cam 85 the punch 73 no longer extends out of the nose 74 and therefore does not contact the set rivet. Thus all the force applied by the actuator is transferred to the sheet materials via the clamping surface of the nose only. The force applied by the actuator may be increased gradually until the desired clamping force is achieved. Finally, the actuator shaft is retracted to the start position and the cam is reset. It will be appreciated that the retraction of the punch may be effected by any appropriate device instead of the cam.

This method of applying a post rivet-insertion clamping force is advantageous in that the force is imparted is not dependent on the C-frame stiffness. The required post rivet-insertion force is applied by simply advancing the nose and driving deflection into the C-frame until the required clamping load is attained regardless of the distance of travel of the lower limb of the C-frame. A load cell is associated with the actuator in such a way as to measure the applied force is used to feed control signals to a control system that governs the actuator advance. The control system can be self-calibrating.

In a modified approach the actuator shaft 80 may be held in position at the full extent of the rivet insertion stroke and the cam 85 rotated by an external actuator whilst the punch 73 is still loaded with the full rivet insertion force. This operation effectively transfers all the force used to insert the rivet R into additional clamping force applied only by the nose without the need for a separate descent of the actuator shaft.

In a further variation to the above described riveting processes, towards the end of the stroke of the actuator shaft 80 its abutment shoulder 81 comes into contact with a disc spring and further advance of the shaft is only possible if there is sufficient drive force to overcome the bias of the disc spring. This force is transferred to the clamping cylinder 71 so that at the end of the rivet insertion this spring will have the effect of providing an additional clamping force during the final stages of rivet insertion. This is desirable as the flow of sheet material out of the die cavity is restrained whilst the rivet is still moving during the final stages of insertion and helps to build compressive stresses into the material around the rivet insertion location and this improve fatigue life of the resulting joint.

The same apparatus may be used to insert a rivet into sheet material without any clamping force prior to rivet insertion but with a selected clamping force during the final stages of rivet insertion. A disc spring (not shown) may be supported on the abutment shoulder 77 of the clamping cylinder 71 so as to provide the clamping force. In such an operation the rivet R is inserted into the end of the nose 74 such that it projects therefrom (see FIG. 9*a*). The clamping cylinder 71 descends as before and the rivet R is insert without any downward movement of the plunger 72 and punch 73 (see FIGS. 9*b* to 9*d*). When the rivet shank is fully inserted and the rivet head is just contacting the upper surface of the sheet material 5 (see FIG. 9*d*) the nose clamping surface 75 comes into contact with the sheet material 5 and imparts a clamping force that is dependent of the characteristics of the disc spring (if fitted). The plunger 72 and punch 73 then travel as before to insert the rivet R fully into the sheet material 5. The clamping force reaches its maximum when the disc spring (if fitted) is fully compressed between the abutment shoulders 81, 77 of the actuator shaft 80 and clamping cylinder 71 and the plunger stop 82 abut the shoulder 83 of the guide bush 78. The post rivet-insertion clamping force is then applied, if required, as described above.

Figures 10A, 10B, 10C:
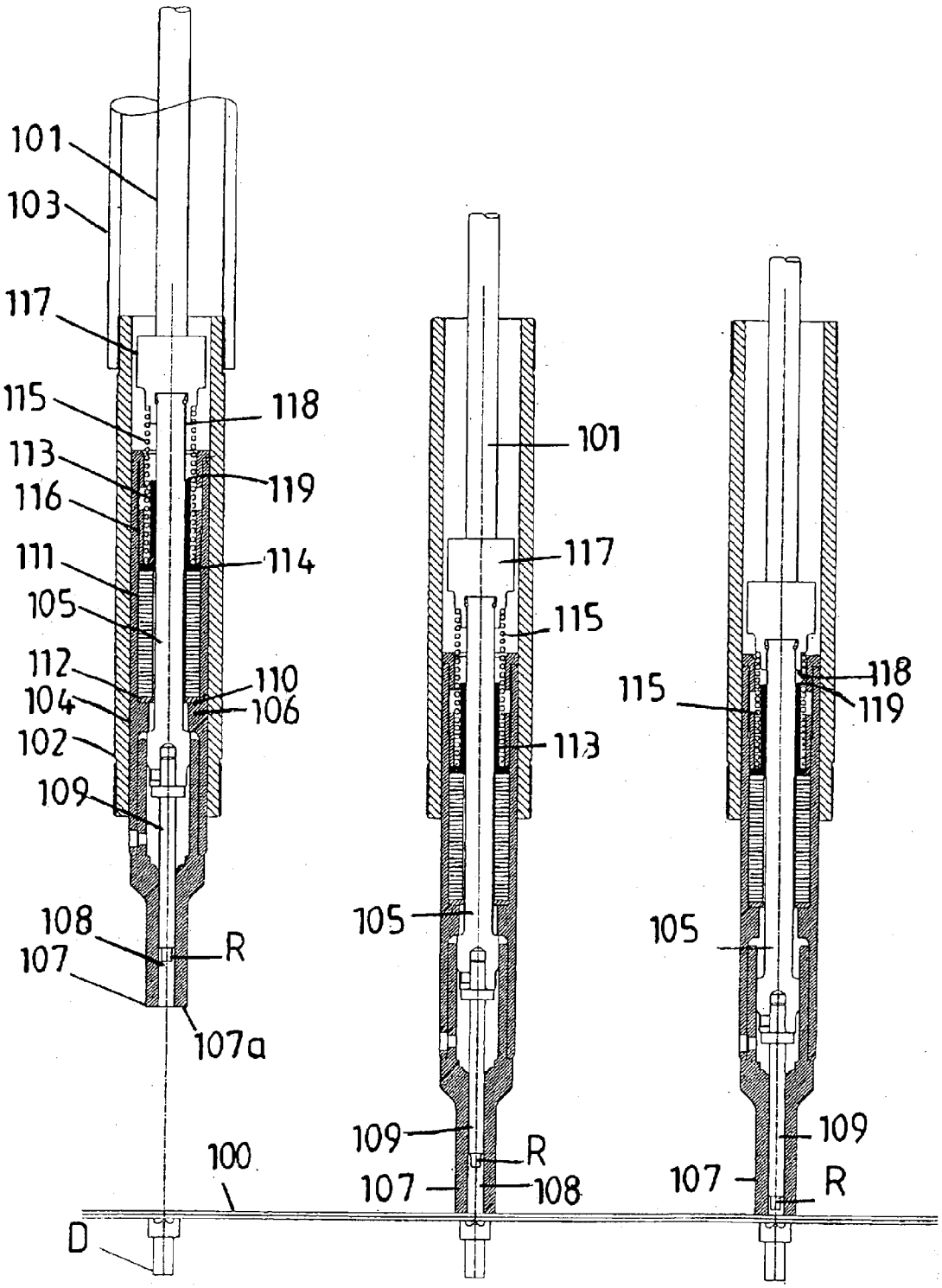
Figure 10D:
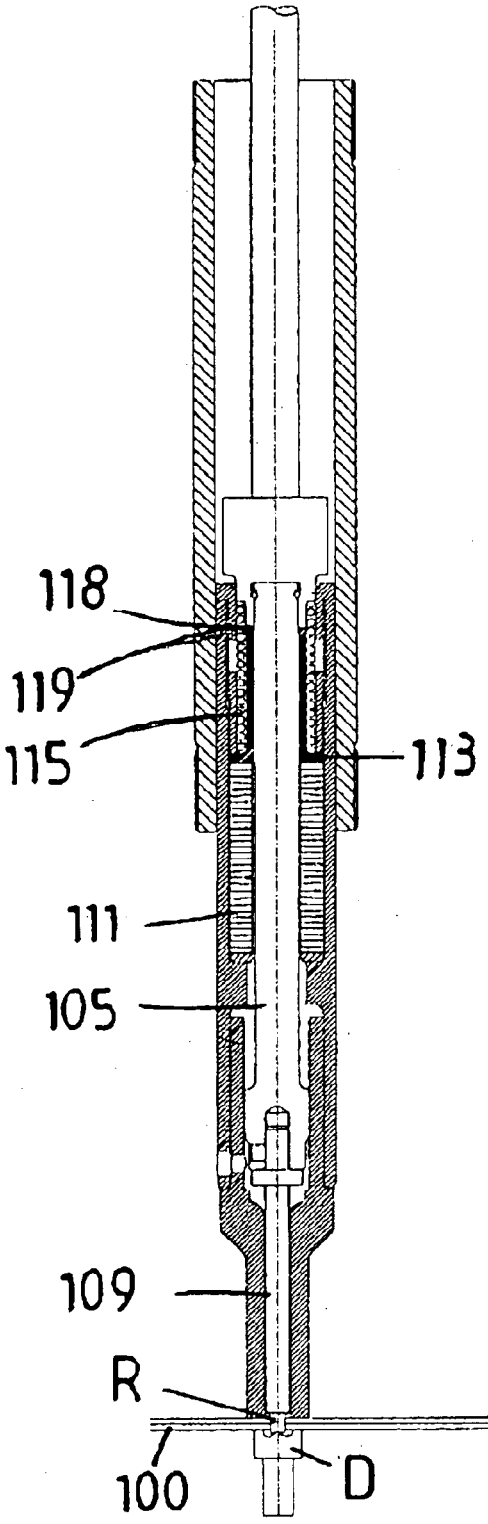

In the embodiment of the rivet setter shown in FIGS. 10*a* to 10*e* a "late" clamping force is applied to the sheet material 100 against a die D at the end of the rivet insertion only. No clamping prior to rivet insertion is applied. Moreover, the punch is not retracted before the final clamping force is applied. The rivet setting apparatus is driven by an actuator comprising an actuator shaft 101 that is coaxially disposed in an actuator housing 103 (an end part of which is shown in FIG. 10*a* only) for reciprocal movement. The actuator can be driven by hydraulic, electric or any suitably powered device.

The rivet setter has a support housing 102 that is coaxially connected to the end of the actuator housing 103 and which carries a concentric clamping cylinder 104 that is slidably disposed therein and in turn receives a slidable reciprocal plunger 105. The clamping cylinder 104 has an internal annular projection 106 below which it receives, in fixed engagement, a nose section 107, the main part of which is of smaller diameter than the rest of the cylinder 104. A punch 109 is coaxially connected on the end of the plunger 105 and is slidably received in an internal rivet delivery passage 108 in the nose section. An end face 107*a* of the nose section 107 at the exit of the delivery passage 108 forms an annular clamping surface for the sheet material 100. The upper surface of the internal annular projection 106 serves as a support shoulder 110 for plurality of disc springs 111 that are arranged in a stack in an annular clearance between the clamping cylinder 104 and the plunger 105. Each disc spring 111 comprises an annulus of spring steel having a thickness of, for example, 2 mm and which is configured such that at rest it is deformed out of a flat plane. Work is done by the clamping cylinder in overcoming the deformed nature of the disc spring so as to deflect them towards a flattened configuration. In practice the disc springs are pre-loaded by approximately 25% of the total available deflection and are not allowed to deflect by more than 75% of the total available deflection. This ensures longevity of the springs. Between the shoulder 110 and the spring stack 111 is one or more removable shims 112 for fine adjustment of the vertical position of the stack 111 (and therefore the pre-load) in the clamping cylinder 104. Seated on the stack 111 is a spring support tube 113 with a radially outward flange 114 at its lower end. Internally, the tube 113 receives the plunger 105 concentrically and slidably therein. Externally, the tube 113 supports one end of a stripper spring 115 and is held against upward movement by an adjustable retention sleeve 116 that is disposed radially outboard of the spring 115. The stripper spring 115 has a relatively low spring force that is of the order of 100 to 200N at full compression and serves to bias the nose towards the die D so that when the plunger 105 extends the nose is supported in place on the sheet material before rivet insertion commences.

The support housings 102, 103 of the rivet setter and the actuator are mounted on a conventional C-frame (not shown in FIG. 10) above the die D. The actuator shaft 101 is drivingly connected to the plunger 105 by a shaft coupling 117 that has an end face 118 configured for abutment with the end face 119 of the spring support tube 113. Initial advancement of the actuator shaft 101 is transmitted via the stripper spring 115, the spring support tube 113 and the stack of disc springs 111 to the clamping cylinder 104 so that it slides out of the support housing 103 (FIG. 10*a*) and the clamping surface 107*a* on the nose 107 comes into contact with the sheet material to be riveted (FIG. 10*b*).

Figure 10E:
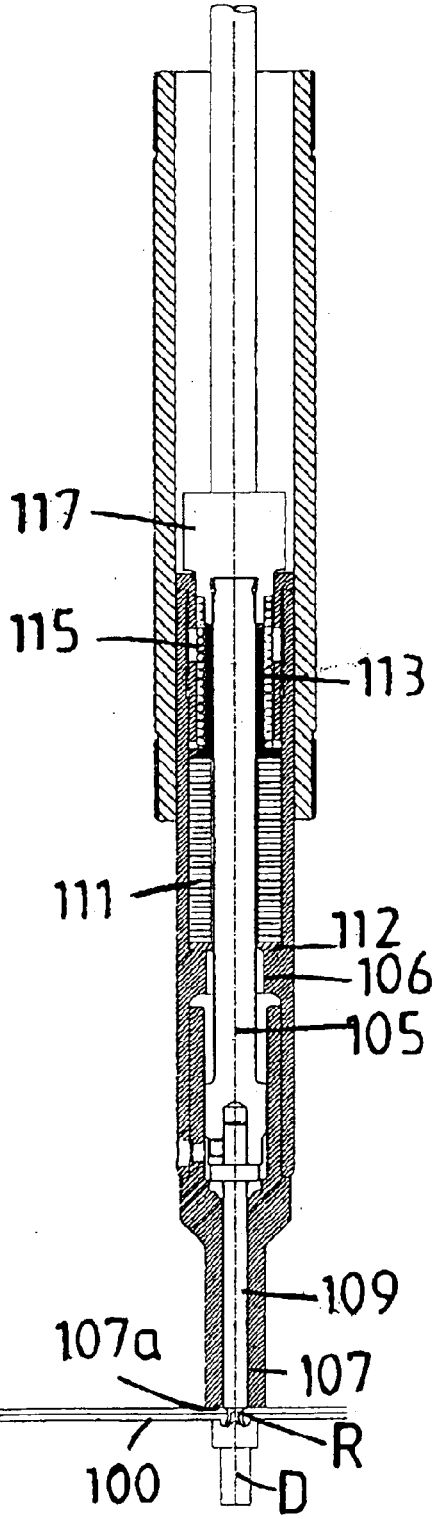

Further advance of the actuator shaft 101 moves the plunger/punch combination axially within the clamping cylinder 104 and compresses the stripper spring 115 between the shaft coupling 117 and the spring support tube 113. The force required to compress the spring 115 is imparted to the sheet material 100 but is so small that it does not have any effect on the sheet material other than to hold the nose steady against the upper surface thereof so as to prevent relative movement or rattling during the riveting operation. The force is not sufficient to be a clamping force that affects the sheet material. The punch 109 comes into contact with a rivet R that has been loaded into the rivet delivery passage 108 (FIG. 10*b*) and moves it into contact with the sheet material 100 (FIG. 10*c*). Further advance of the plunger 105 and punch 109 drives the rivet R into the sheet material. Before the rivet R is fully inserted the end face 118 of the shaft coupling 117 abuts the end face 118 of the spring support tube 113 whereupon the a proportion of the driving force of the actuator shaft 101 is, transferred to the support tube 113 and in turn compresses the stack of disc springs 111 (FIG. 10*d*) so that the individual disc springs are compressed. The required actuator force for maximum (75% of the total available deflection) compression of the stack is dependent on the number and type of the springs present and the amount of pre-load but can be selected to be typically in the region of 4 to 8 kN. The reaction force of the disc springs 111 is transmitted via the annular projection 106 to the nose 107 and results in it being applied as a clamping force to the sheet material 100 by the clamping surface 107*a* of the nose 107. The limited movement of the support tube 113 as a result of compression of the disc sprig 111 (approximately 1 mm in total in the embodiment shown) allows the shaft coupling 117 and the plunger 115 to move through the same distance and thereby complete insertion of the rivet R (FIG. 10*e*).

The delayed application of the clamping force means that during the initial phases of rivet insertion the lack of clamping force allows sheet material 100 in the region immediately around the rivet insertion location to be displaced. The displacement mainly occurs in the upper sheet of material surrounding the rivet shank as A result of it being dragged towards the rivet and into the die cavity as the rivet is inserted. The material immediately around the rivet R is deformed into an annular valley and relatively low tensile stresses are set up in it. The subsequent application of the clamping force is timed so as to occur just as the rivet head is being pressed flush with the sheet material. At this time the displaced material that has been dragged into the joint reverses in direction and is pushed back out of the die cavity by the rivet as it is upset. Ordinarily this movement of material would cause an annular distortion around the joint but the clamping force serves to restrain this reverse flow and helps to create compressive stresses around the rivet head and shank. This clamping force is sufficient to flatten any distortion of the sheet material around the rivet insertion location that occurs during the initial unclamped rivet insertion stage. Moreover, the force brings the sheet materials into intimate contact in the region surrounding the rivet so as to ensure that it is a secure, gap free joint.

It has been found in tests that a ramped (rather than stepped) application of the clamping force late in the insertion of the rivet through use of disc springs or another compressible element is surprisingly beneficial. Joints produced by this process have significantly improved fatigue life over a joint that is produced by having a hard stop (and therefore immediate stepped application of a clamping force) between the plunger and the nose. The application of the ramped clamping force maintains a balancing of force between the plunger/punch and the nose. Of course, in applications where fatigue life of a joint is not a major concern the disc spring stack can be eliminated and the joint can be produced with a hard stop between the plunger and the nose. This may be desirable if precise control of the rivet head height relative to the sheet metal is of paramount importance.

The application of a clamping force late in the rivet insertion process enables the clamping spring to be of compact design with relatively little travel during compression in comparison to rivet setters that use a clamping spring throughout the riveting cycle (including descent of the plunger and insertion of the rivet). As discussed above, the life of a spring is dependent in part on its length of travel during compression and so limiting travel ensures its design is easier to incorporate into the confined space available. A stack of disc springs is therefore very suitable and has a life expectancy of typically 4 million cycles. In addition, the arrangement allows one clamping spring (or set of springs) to be used for a variety of different rivet lengths or other fasteners since the spring is only used in the final stages of insertion. This is in contrast to a conventional clamping spring that is applied prior to and throughout rivet insertion as this must be selected to have sufficient deflection to accommodate the whole length of the rivet or fastener.

An additional benefit of the above described arrangement is the reduced energy required to effect clamping. Thus is because a traditional clamping spring is compressed for the full plunger stroke which is, typically, at least ten times (for a rivet of 10 mm length) greater than the distance the plunger travels in compressing the clamping spring of the apparatus shown in FIG. 10.

In certain applications, prior to riveting, adhesive may be applied between the sheets in and around the region of rivet insertion to improve the strength of the finished joint. When the riveting operation is effected, the adhesive flows gradually away from the rivet insertion location first by virtue of the force involved in inserting the rivet and then upon the ramped application of the clamping force. There is thus a progressive dispersion of the adhesive resulting in a joint of improved strength. This contrasts with a rivet setting process in which a clamping force is applied prior to rivet insertion and the adhesive is thus expelled rapidly from the joint area before the rivet is inserted.

The present invention is particularly (but not exclusively) suitable for both electric and hydraulically driven rivet setters. A hydraulic rivet setter with late application of the clamping force has a single-stage operation and therefore a faster cycle time than a two-stage hydraulic setter in which there is a pause in the process between the stages of applying the clamping force and inserting the rivet.

Tests have established that for some joint types the absence of a clamping force prior to rivet insertion can allow for a reduced rivet insertion force. Joints made in relatively thick sheets may be best suited to zero clamping force prior to rivet insertion and a relatively high post clamping force during the final stages of rivet insertion.

It is to be understood that the present invention has application to clinching technology such as that described in our aforementioned European Patent No. 0614405.

It will be appreciated that numerous modifications to the above-described design may be made without departing from the scope of the invention as defined in the appended claims. For example, the main cylinder in the embodiment of FIG. 6 may alternatively have an internal screw thread engaged by a drive mechanism to control advancement. Furthermore, the embodiment described in relation to FIGS. 2 and 3 may be modified such that the actuator 23 serves to hold the mechanical linkage 20 with the aid of mechanical advantage, or the linkage 20 may be moved to a position where it travels over-centre and locks the linkage in place. The hydraulic locking device described earlier may be used in conjunction with a clamping cylinder that is moved under the influence of a spring force.

It is to be understood that the present invention has application to a hand-held riveting or clinching gun. Moreover, the method of inserting a fastener of the present invention can be used not only in applications in which two or more sheets of material are to be joined but also has application to the insertion of a fastener, such as a stud, into a single sheet of material. Such a stud may be used as a fixing to connect to another component.

The invention may be used in conjunction with a self-piercing rivet insertion actuator that operates to drive the rivet by multiple impacts at a pulsated excitation frequency such as that described in European Patent Application EP-A-0890397.

What is claimed is:

1. A method for inserting a fastener into sheet material comprising inserting the fastener into at least one sheet without full penetration such that a deformed end of the fastener remains encapsulated by an upset annulus of the sheet material, the sheet material being disposed between a nose and a die of the fastening apparatus and the fastener being inserted into the sheet material by means of a plunger that is reciprocal relative to the nose, characterized in that, during a first stage of fastener insertion there is no significant clamping force so that the sheet material around the fastener insertion location is free to be displaced without significant constraint towards the fastener by virtue of its insertion, and thereafter during a second stage (being after said first stage) of fastener insertion a clamping force of sufficient magnitude is applied between the nose and the die in the region around fastener insertion location so as substantially to prevent flow of displaced sheet material away from the fastener.

2. The method according to claim 1, wherein during the first stage of fastener insertion the nose of the apparatus is biased into abutment with the sheet material so as to provide stable contact between the two.

3. The method according to claim 1, wherein the second stage of fastener insertion is when a head part of the fastener is pressed flush with an upper surface of the sheet material.

4. The method according to claim 1, wherein the first stage of the fastener insertion comprises entry of the fastener into the sheet material and the second stage comprises the fastener being pressed substantially flush with an upper surface of the sheet material.

5. The method according to claim 4, wherein the clamping force applied during the second stage of fastener insertion increases until the fastener is fully inserted.

6. A method for inserting a fastener into sheet material comprising inserting the fastener into at least one sheet without full penetration such that a deformed end of the fastener remains encapsulated by an upset annulus of the sheet material, the sheet material being disposed between a nose and a die of the fastening apparatus and the fastener being inserted into the sheet material by means of a plunger that is reciprocal relative to the nose, characterized in that, during a first stage of fastener insertion comprising entry of the fastener into the sheet material, no clamping force is applied to the sheet material in the region around the fastener insertion location and the sheet material around the fastener insertion location is displaced towards the fastener by virtue of its insertion, and thereafter during a second stage (being after said first stage) of fastener insertion comprising the fastener being pressed substantially flush with an upper surface of the sheet material, a clamping force of sufficient magnitude is applied between the nose and the die in the region around fastener insertion location so as substantially to prevent flow of displaced sheet material away from the fastener.

7. A method for inserting a fastener into sheet material comprising inserting the fastener into at least one sheet without full penetration such that a deformed end of the fastener remains encapsulated by an upset annulus of the sheet material, the sheet material being disposed between a nose and a die of the fastening apparatus and the fastener being inserted into the sheet material by means of a plunger that is reciprocal relative to the nose, characterized in that, during a first stage of fastener insertion the sheet material around the fastener insertion location is displaced towards the fastener by virtue of its insertion, and thereafter during a second stage (being after said first stage) of fastener insertion a clamping force of sufficient magnitude is applied between the nose and the die in the region around fastener insertion location so as substantially to prevent flow of displaced sheet material away from the fastener, said clamping force is provided by compression of a compressible member that is disposed between the plunger and the nose.

8. The method according to claim 7, wherein the compressible member is a plurality of disc springs.

9. An apparatus for inserting a fastener into sheet material without full penetration such that a deformed end of the fastener remains encapsulated by an upset annulus of the sheet material, said apparatus comprising a nose in which is disposed a reciprocal plunger, means for feeding fasteners successively to the nose for insertion by the plunger into the sheet material, a die aligned with the plunger for deforming the fastener being inserted, the sheet material being disposed between the nose and die during the fastening operation, characterized in that there is provided means for applying a clamping force at a predetermined point during insertion of the fastener, said means for applying the clamping force comprising a compressible member that is disposed between the plunger and the nose and is compressed when the plunger reaches a predetermined position relative to the nose and said means for applying the clamping force allowing the sheet material around the fastener insertion location to be displaced by the fastener towards the fastener during a first stage of fastener insertion, and thereafter during a second stage (being after said first stage) of fastener insertion applies a clamping force of sufficient magnitude between the nose and the die in the region around fastener insertion location so as substantially to prevent flow of displaced sheet material away from the fastener.

10. The apparatus according to claim 9, wherein the compressible member is a plurality of disc springs.

11. The apparatus according to claim 9, wherein the first stage comprises entry of the fastener into the sheet material and the second stage comprises the fastener being pressed substantially flush with an upper surface of the sheet material.

12. The apparatus according to claim 9, wherein there is a stop member connected to the compressible member and disposed between the nose and plunger such that when said plunger reaches said predetermined position it contacts the stop member and compresses said compressible member so as to apply the clamping force.

13. The apparatus according to claim 12, wherein the nose has a clamping surface that applies the clamping force.

14. The apparatus according to claim 13, further comprising a clamping cylinder slidable reciprocal in a housing, the clamping cylinder having a end to which the nose is connected.

15. The apparatus according to claim 9, wherein the nose is biased towards the die by biasing means such that, in use, the nose is held stable against the sheet material prior to and during the first stage of fastener insertion.

16. The apparatus according to claim 15, wherein said biasing means is disposed between said plunger and said nose so as to bias them apart in an axial direction, the nose being biased towards the die, and movement of the plunger in the direction of insertion of the fastener overcomes the force of said biasing means.

17. The apparatus according to claim 16, wherein the biasing means is a spring.

18. The apparatus according to claim 17, wherein the spring is a compression coil spring.

19. The apparatus according to claim 9, further comprising biasing means disposed between said plunger and said nose so as to bias them apart in an axial direction, the nose being biased towards the die, and movement of the plunger in the direction of insertion of the fastener overcomes the force of said biasing means, and a support member disposed on the compressible member and supporting the biasing means.

20. The apparatus according to claim 19, wherein the support member has a stop surface for contact with the plunger, and after a predetermined length of travel of the plunger relative to the nose the plunger contacts the stop surface and pushes the support member against the compressible member so that it compresses and applies the clamping force.

21. The apparatus according to claim 20, wherein the plunger contacts the stop surface as it emerges from the nose so as to complete insertion of the fastener.

22. A panel clinching method wherein two or more sheets of material are deformed into locking engagement, the sheet material being disposed between a nose and a die of a fastening apparatus, the sheet material being deformed by means of a plunger that is reciprocal relative to the nose, characterized in that, during a first stage of deformation, there is no significant clamping force so that the sheet material around the deformation region is free to be displaced without significant constraint towards the plunger by virtue of its insertion into the material, and thereafter during a second stage (being after said first stage) of deformation a clamping force of sufficient magnitude is applied between the nose and the die in the region around the deformation so as substantially to prevent flow of displaced sheet material away from the plunger.

* * * * *